United States Patent [19]

Rosman et al.

[11] Patent Number: 4,893,673

[45] Date of Patent: Jan. 16, 1990

[54] ENTRY PORT INSERTS FOR INTERNALLY MANIFOLDED STACKED, FINNED-PLATE HEAT EXCHANGER

[75] Inventors: Irwin E. Rosman, Rancho Mirage; William R. Wagner, Los Angeles, both of Calif.

[73] Assignee: Rockwell International Corporation, El Segundo, Calif.

[21] Appl. No.: 666,866

[22] Filed: Oct. 31, 1984

[51] Int. Cl.[4] ..... F28F 3/08; F28F 3/04

[52] U.S. Cl. ..... 165/167; 165/166; 29/157.3 B

[58] Field of Search ..... 165/167, 166

[56] References Cited

U.S. PATENT DOCUMENTS

| | | | |
|---|---|---|---|
| 1,992,097 | 2/1935 | Seligman | 165/167 |
| 2,782,010 | 2/1957 | Simpelaar | 165/167 |
| 4,347,896 | 9/1982 | Rosman et al. | 165/166 |
| 4,403,652 | 9/1983 | Schiltz et al. | 165/167 |

FOREIGN PATENT DOCUMENTS

| | | | |
|---|---|---|---|
| 9269 | 3/1983 | Fed. Rep. of Germany | 165/167 |

*Primary Examiner*—Albert W. Davis, Jr.
*Attorney, Agent, or Firm*—H. Fredrick Hamann; Harry B. Field; Steven E. Kahm

[57] ABSTRACT

An internal plate assembly for a heat exchanger comprising a plate and a pair of substantially identical inserts. The plate is formed with a manifold area at opposite ends. A pair of wall members and a plurality of fins extending therebetween. Each manifold area of the plate is provided with two ports. A flat identical insert is provided for each manifold area. The insert has one port for mating with one of the ports in the manifold area of the plate and is formed to avoid covering the other port in that same manifold area. Thus, it is possible to construct a multi-plate stacked heat exchanger utilizing parts having only two distinct configurations.

5 Claims, 3 Drawing Sheets

Fig.1.
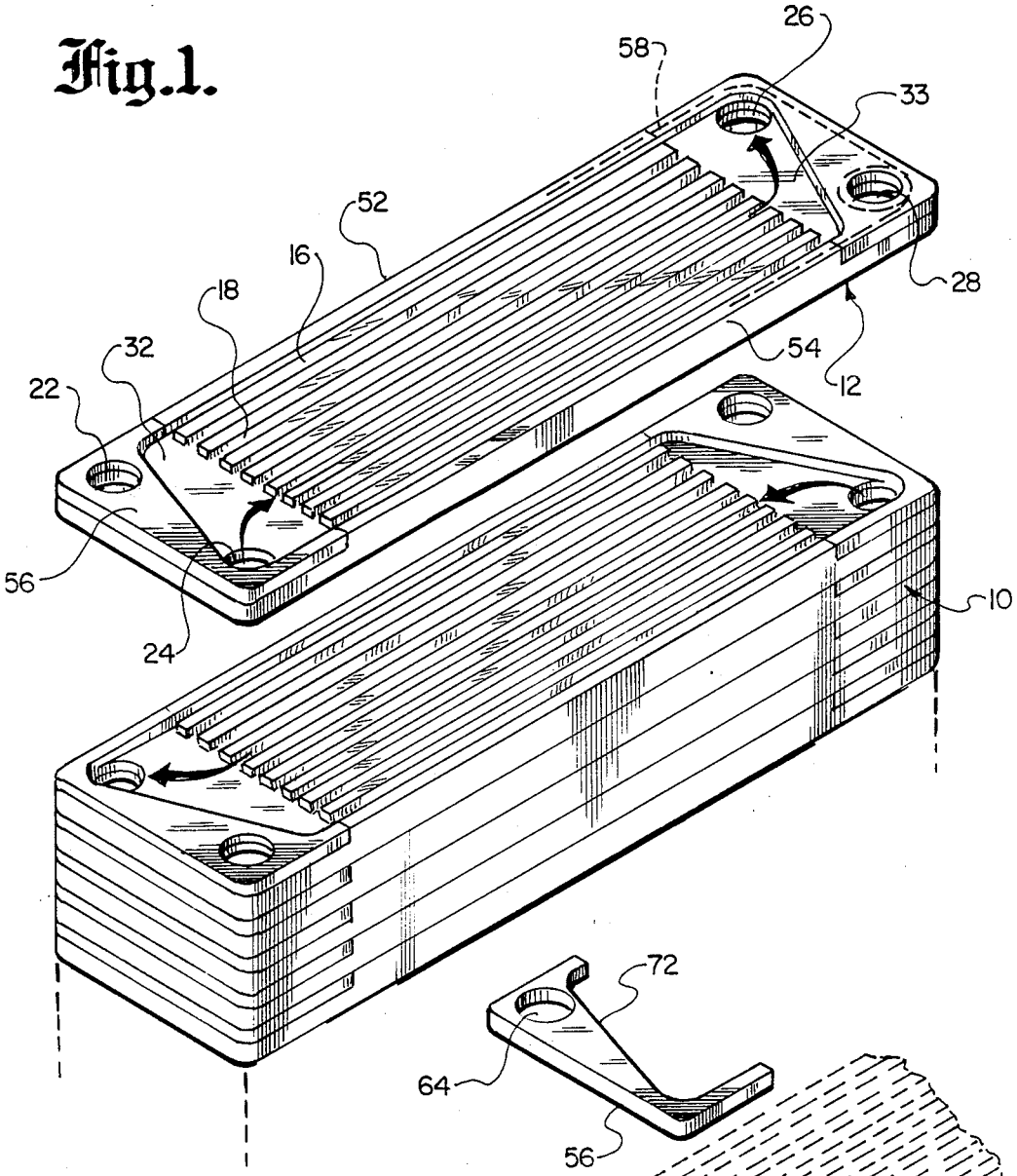
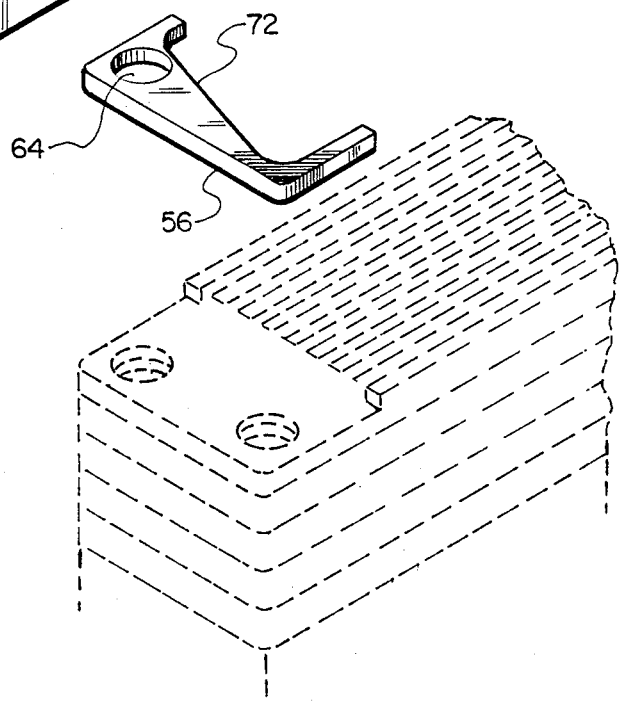
Fig.2.

Fig.3.
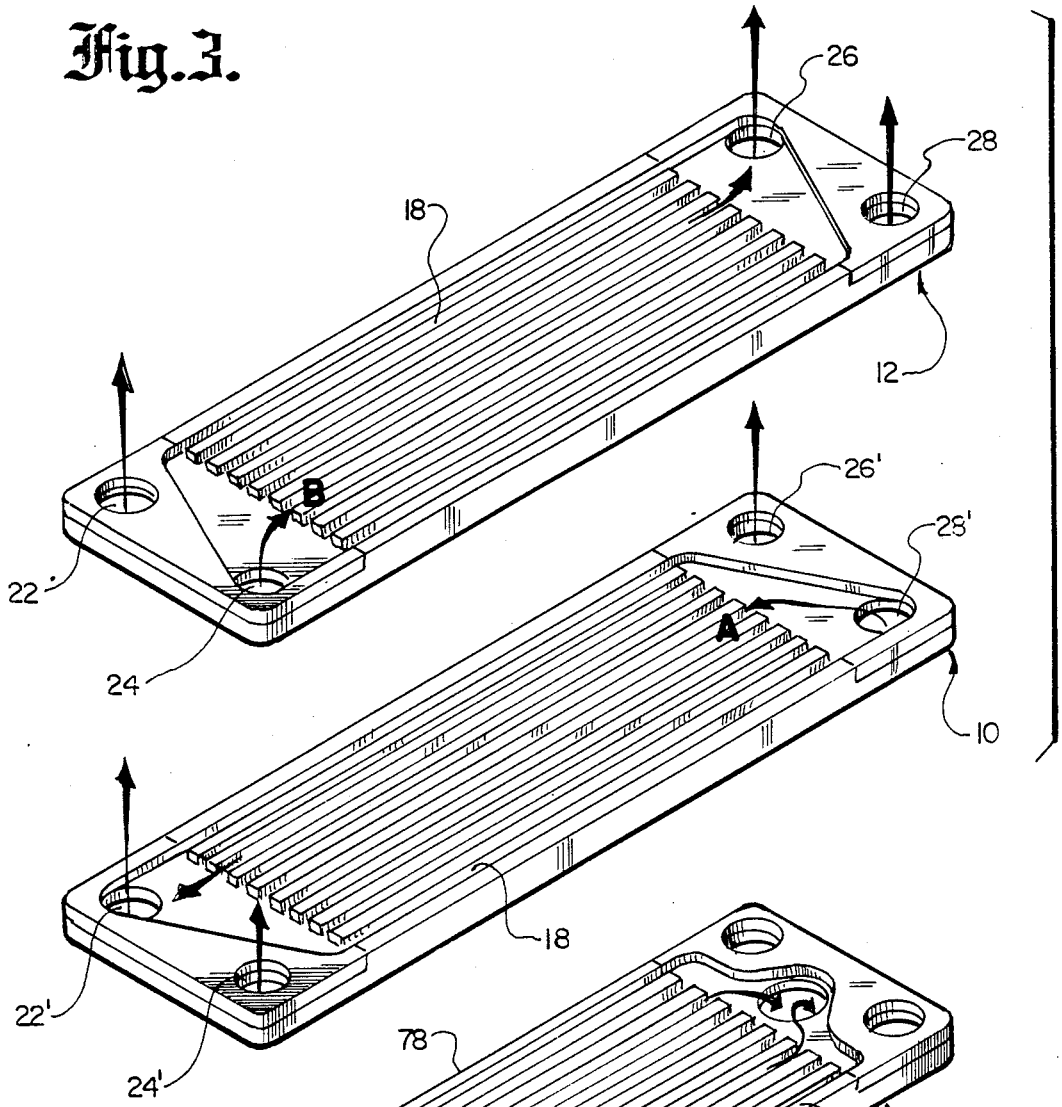
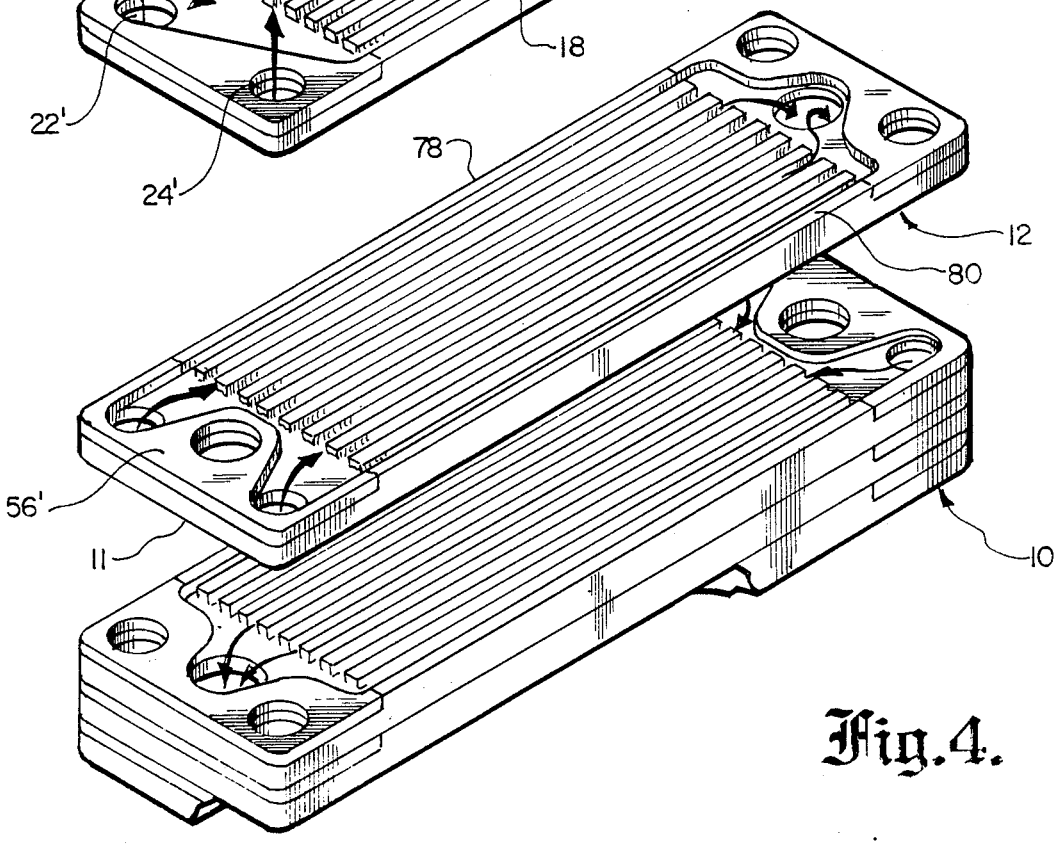
Fig.4.

ENTRY PORT INSERTS FOR INTERNALLY MANIFOLDED STACKED, FINNED-PLATE HEAT EXCHANGER

BACKGROUND OF THE INVENTION

This invention relates to plate-stack heat exchangers and especially to plate-stack heat exchangers with internal manifolding.

Finned-plate heat exchangers are mainly of the channel and rib-type construction. Countercurrent flow can be achieved; however, manifolding a plate stack which must separate the fluids at entry and exit becomes extremely complex. Since the manifolding of the crosscurrent heat exchangers is comparatively simple, this heat exchanger system is more widely used although it is less efficient than the countercurrent system and it induces serious thermal and mechanical stresses.

One crosscurrent system which has attempted to solve the manifolding problem of the countercurrent heat exchanger is taught by Campbell et al, U.S. Pat. No. 3,305,010. Campbell et al teach a heat exchanger having superposed stacked plate and fin elements and complex manifolding means for introducing fluids of different temperatures into opposite ends of the assembly. However, Campbell et al do not teach a plate which serves as both the plate and the fin, nor does Campbell et al teach means for internally manifolding the plate within the plate's plane.

One of the problems in the stacked-plate type of heat exchanger is the blocking of a selected internal entry port in a plate at any stack level to prevent fluid flow from the selected port through the channels of that plate and to pass the fluid coming into the port to the next plate level where the fluid is permitted to flow through the channels.

OBJECTS OF THE INVENTION

An object of the present invention is to provide a finned plate for an internally manifolded plate-stack heat exchanger.

Another object is to provide a means for passing the fluid entering a given port in a first plate to a port in the next higher plate without permitting the fluid from that port to flow through the channels of the first plate.

SUMMARY OF THE INVENTION

The invention comprises an internally manifolded, countercurrent, finned-plate, stack heat exchanger, each internal plate having manifold areas at opposite ends thereof. Flow, or fluid entry, ports are excised through the plate, at least two at each manifold area. The ports and the fins are formed so that the plates can be rotated 180° without changing the relative overall appearance of the plates; i.e., the ports of the rotated plate will still be in mating position with the ports of an unrotated plate when the two plates are stacked.

To pass the fluid through an entry port in a first plate to the next higher stacked plate without permitting it to flow through the channels in the first plate, an insert as placed on a manifold area with a port excised therethrough in the same relative location as the selected port in the manifold area. The height of the insert is equal to the height of the space between the top of the manifold area and the bottom of the next higher plate in the stack. An insert is placed on each manifold area and forms an end wall for the plate at that area.

In plates which have an even number of entry ports per manifold area, the same inserts may be used at each manifold area. In plates which have an odd number of ports per manifold area, the two inserts used at opposite ends of a single plate form a complementarily shaped set of inserts. The plate immediately above will use another identically shaped set of inserts but each one of the set will be positioned at the opposite end of the plate relative to its position on the plate immediately below.

Other objects, advantages and novel features of the present invention will become apparent from the following detailed description of the invention when considered in conjunction with the accompanying drawing.

BRIEF DESCRIPTION OF THE FIGURES

FIG. 1 is a schematic diagram illustrating two internal plates in a plate-stack heat exchanger according to one embodiment of the invention.

FIG. 2 is a schematic diagram of an insert which is used with a plate having manifold areas with two ports in each of them.

FIG. 3 is a schematic diagram illustrating fluid flow through the ports and channels of two adjacent internal plates of a plate stack.

FIG. 4 is a schematic diagram illustrating two internal plates according to a second embodiment of the invention

The same elements or parts throughout the figures of the drawing are designated by the same reference characters, while equivalent elements bear a prime designation.

DETAILED DESCRIPTION OF THE INVENTION

Figure 5:
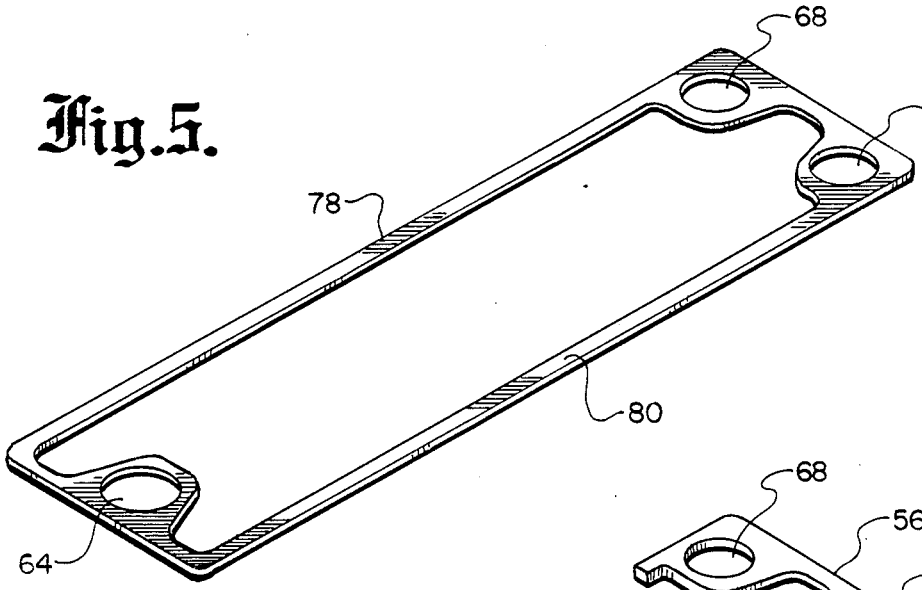
FIG. 5 is a schematic diagram of the inserts formed as an integral unit for the second embodiment of the invention.

FIG. 1 is a schematic view of two internal, adjacent, finned-channel plates according to a first embodiment of the invention in which each end of the plate has an even number of fluid entry ports. For illustrative purposes, two ports are shown at each end. The lower and upper plates, 10 and 12 respectively, are preferably rectangular and are formed with parallel, longitudinal, upstanding fins 16 which define longitudinal channels 18 between them. The plates may be formed of metal by a roll forming or pressing extrusion process, for example, and the end areas may be milled off to be coextensive with the bottom plane of the fins 16. A pair of spaced, fluid-entry ports 22 and 24 are drilled through one flat end and another pair of ports 26 and 28 are drilled through at similar locations on the other flat end.

It may be desirable in some applications to form a groove 58 on the top of the peripheral wall 52 and the inserts 56 at each end and insert a flexible fluid-sealing material therein to seal off the contact areas between the plate and the one above it.

A flat insert 56 (see FIG. 2) is placed upon one flat end of the plate, e.g., plate 12, and forms a manifold area 32 between its diagonal side 72 and the ends of the fins 16. A similar manifold area 33 is formed by the insert located on the other end of the plate 12. The insert 56 is formed with one port 64 through it and the diagonal side 72 is located so that the insert body does not cover the second port 24 through the same manifold area 32 on the plate. The insert 56 is placed on the manifold area 32 as shown so that the insert's entry port 64 mates with the manifold entry port 22. An identical insert rotated 180° in orientation is placed on the opposite manifold area 33 so that the insert port mates with the manifold port 28 and manifold port 26 is left uncovered. The inserts 56 are bonded to the plate 12 and to the midsection peripheral walls 52 and 54 so that a complete wall encloses the fins and the manifold areas.

FIG. 3 shows, by means of arrows, fluid-flow directions through the ports and channels of two adjacent plates in a plate stack. Fluid A comes up through port 28' in lower plate 10, flows through the channels 18 in the plate and passes up through port 22 in the upper plate 12 where it is blocked from entering the channels and must proceed upward to the next plate (not shown). Fluid B is passed upward from port 24' in plate 10 through port 24 in plate 12, whence it proceeds through the channels 18 in plate 12 and passes up through the port in the next higher plate (not shown) which sits above port 26 in plate 12. It can be seen that the flows of the fluids in the channels of adjacent plates are counter to each other.

Figure 6:
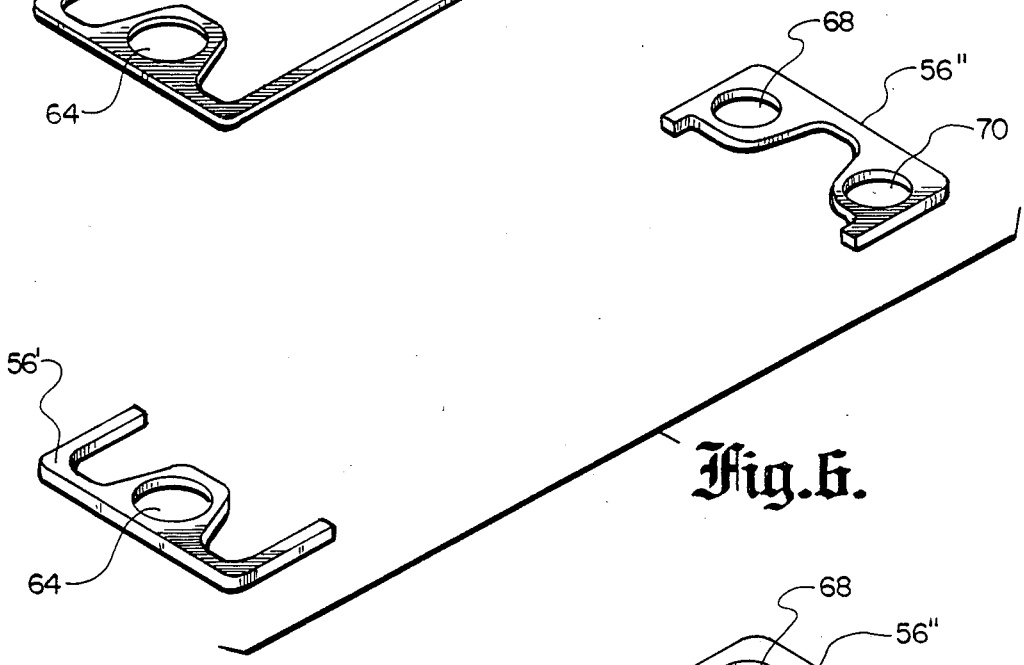
FIG. 6 is a schematic diagram illustrating a complementary set of inserts for use with a plate which has midsection peripheral walls.
Figure 7:
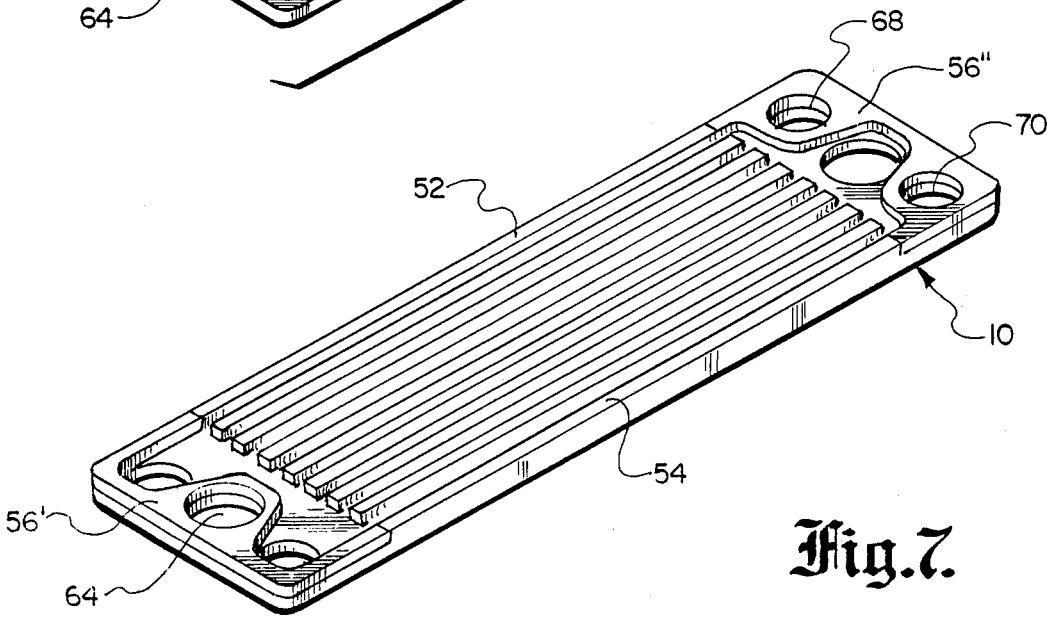
FIG. 7 is a schematic diagram showing how a set of inserts fits on a plate.

FIG. 4 shows schematically two adjacent internal plates 10 and 12 formed with three ports on each manifold area. The two inserts for a single plate are formed here as an integral unit (see FIG. 5), the port sections being connected by midsection wall units 78 and 80, so that the entire insert unit forms a complete wall around the fins and the manifold areas. It should be noted that the port sections of the insert are complementarily shaped and may be made as separate pieces, as shown by inserts 74 and 76 (see FIG. 6). In this case, the same set of inserts would be employed on the adjacent plate but at the opposite ends relative to their positions on the first plate. FIG. 7 shows the set of inserts 56' and 56'' in place on a plate 10. To visualize how the next higher adjacent plate 12 would look, the plate 10 and the inserts 56' and 56'' should be rotated through an angle of 180°.

What has been described herein is an internal plate for a plate-stack heat exchanger with means for passing the fluid flowing along a first plate to an alternate plate stacked above it and for preventing the flow from entering the next adjacent plate above the first plate through an entry port in the adjacent plate.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An internal plate assembly for a plate-stacked heat exchanger comprising:

a four-sided plate having an upper face and a flat lower face, the upper face having a flat surface adjacent two opposite sides thereof, the upper surface having a wall upstanding therefrom extending along each of the other two sides, a plurality of upstanding fins centrally located upon said upper face and extending substantially parallel with and between the walls, the spaces between the fins defining a plurality of channels, the plate further including first and second ports located in each of the flat surfaces adjacent the sides at such locations that the plate may be rotated 180° from another such plate and the ports in both plates will still occupy mating positions; and means for passing a fluid flowing along a first plate to an alternate plate stacked above it and for preventing the flow from entering a next adjacent plate above the first plate through an entry port in the adjacent plate, said next adjacent plate being stacked between said first plate and said alternate plate, said means including a pair of substantially identical flat inserts, each of said inserts having a port therethrough to mate with one of the ports adjacent one side of said plate and further being formed to avoid covering the second port in the same side of said plate, the top surface of the insert being coplanar with a top surface of the walls and fins such that said pair of inserts and the walls enclose the periphery of said fins, and said inserts and the flat surfaces on the upper face of said plate form an open manifold area providing fluid communication between one of said ports in said plate and the plurality of channels.

2. The plate assembly of claim 1, wherein covered ports at opposite sides of the plate are diagonally located with respect to one another.

3. The plate assembly of claim 1 wherein said inserts are bonded to ends of the walls of said plate.

4. The assembly of claim 1 wherein are provided a plurality of said plates and a plurality of said pairs of inserts.

5. The plate assembly of claim 1 wherein covered ports in one plate are in alignment with uncovered ports in adjacent plates.

* * * * *